United States Patent [19]

Clark

[11] 4,133,629

[45] Jan. 9, 1979

[54] COMBUSTION SYSTEM CONTROL

[75] Inventor: William C. Clark, Marton, England

[73] Assignee: Phillips Petroleum Company, Bartlesville, Okla.

[21] Appl. No.: 821,253

[22] Filed: Aug. 2, 1977

[51] Int. Cl.[2] ..... F23C 1/00

[52] U.S. Cl. ..... 431/12; 60/39.18 B; 122/7 R

[58] Field of Search ..... 60/39.18 B; 431/12, 431/89, 90, 29, 30, 31; 122/7; 236/15 BD

[56] References Cited

U.S. PATENT DOCUMENTS

| | | | |
|---|---|---|---|
| 3,314,231 | 4/1967 | Hochmuth | 60/39.18 R |
| 3,374,621 | 3/1968 | Pacault et al. | 60/39.18 B |
| 3,422,800 | 1/1969 | La Haye | 122/7 |
| 3,734,675 | 5/1973 | Osborn | 431/12 |

*Primary Examiner*—Roy D. Frazier
*Assistant Examiner*—Robert W. Gibson, Jr.

[57] ABSTRACT

In a system for combustion of fuel to produce heat in which there are alternate primary and secondary means to supply combustion air and in which the fuel flow is ratioed to the total air flow, the flow of fuel to the combustion chamber is controlled on shutdown of operation of the primary means for supplying combustion air by activating the secondary means for supplying combustion air and relaying a signal to the ratio controller which falsely indicates sufficiently low flow of air to the combustion chamber to cause an immediate reduction of flow of fuel to the combustion chamber to be within safe limits.

5 Claims, 2 Drawing Figures

COMBUSTION SYSTEM CONTROL

BACKGROUND OF THE INVENTION

This invention relates to the combustion of fuel to produce heat. In one of its aspects this invention relates to the controlled combustion of fuel. In another of its aspects this invention relates to supplying to a combustion chamber an amount of fuel ratioed to an amount of combustion air supplied. In still another of its aspects this invention relates to control of fuel flow during a period of shifting from a primary means of supplying combustion air to a secondary means for supplying combustion air.

This invention has arisen from a specific situation in which hot exhaust gas from a combustion gas turbine is used as a source of heat and oxygen for burning supplemental fuel for a boiler or a heater. The invention is applicable, however, in any system in which combustion air is supplied from a primary air mover that has a backup, secondary air mover that is used in time of emergency shutdown of the primary means for supplying combustion air. Most combustion gas turbines supplying exhaust gas to waste heat boilers, for instance, have a fresh air blower that is started and supplies combustion air when the gas turbine is shut down or tripped off.

The control of fuel and air supply in these combustion systems usually incorporates a conventional "lead-lag" fuel and air control system which, among other things, will detect a condition of insufficient combustion air and match it with a fuel rate that is ratioed to be safe regardless of the demand. Past experience has proven, however, that upon emergency shutdown of the primary means for supplying combustion air there is usually such rapid decay of air supply that the control limiting the fuel is unable to keep pace, causing the heating system to go through a dangerous period of excess fuel. Up to now it has been common practice to run the secondary means for supplying combustion air at all times so that it will be up to speed at any time it might be needed. Avoiding the use of energy required for running the standby system when it is not needed would, of course, improve the economics of the combustion system, but, more importantly, would eliminate a useless expenditure of energy.

It is, therefore, an object of this invention to provide a safe and economical method for controlling the flow of fuel to a combustion chamber during the shifting of operation from a primary means for supplying combustion air to a secondary means for supplying combustion air. It is another object of this invention to provide apparatus for controlling the flow of fuel to a combustion chamber during the shifting from a primary means of supplying combustion air to a secondary means of supplying combustion air.

Other aspects, objects, and the various advantages of this invention will become apparent upon study of this specification, the drawings, and the appended claims.

STATEMENT OF THE INVENTION

In a system for combustion of fuel to produce heat in which there are alternate primary and secondary means to supply combustion air and in which the fuel flow is ratioed to the total air flow, a method is provided for controlling the fuel flow to the combustion chamber on shutdown of operation of the primary means for supplying combustion air. In this method the secondary means for supplying combustion air is activated on shutdown of the primary means for supply of combustion air and a first signal falsely indicating low flow of air to the combustion chamber is relayed to a ratio controller controlling the fuel flow. This signal indicates sufficiently low flow of air immediately to reduce the flow of fuel to the combustion chamber so that it will be within safe limits. A falsely indicated low flow of air is continued for a time sufficient to allow the secondary means of supplying combustion air to come up to speed so the control of the fuel system can be safely shifted to the normal controlling system. In actual practice the false signal is continued for a time sufficient for flow from the secondary means of supply of combustion air to reach a predetermined level, the first signal is then increased automatically until it is greater than a second signal indicating actual flow of air and control of the fuel control valve is shifted to the second signal as the first signal becomes greater than the second signal.

The control apparatus necessary for carrying out the method of the invention is made up of a valve for controlling the flow of fuel, a ratio controller generating a signal to operate the fuel control valve, a low signal selector relay switch which selects the input signal for the ratio controller, a device generating a signal to the low signal selector indicating the total combustion air flow, and a device actuated by the shutdown of the primary means of combustion air supply which generates a false signal sufficiently low to reduce fuel flow so that it is within safe limits during the actual period of low air flow.

To accomplish the switch-over of control of the fuel flow to be dependent on the flow of combustion air supplied by the secondary means of supplying combustion air, the controls in the system must contain a means for continuing the original false signal for a time sufficient for flow from the secondary means of supply of combustion air to reach a predetermined level; a means for generating a second signal indicating the actual flow of air; a means for automatically increasing the first signal until it is greater than the second signal; and a means for shifting control of the fuel control valve to the second signal as the first signal becomes greater than the second signal.

Both the method of the invention and the apparatus necessary for carrying out this method can best be understood in conjunction with the drawing in which.

Figure 1:
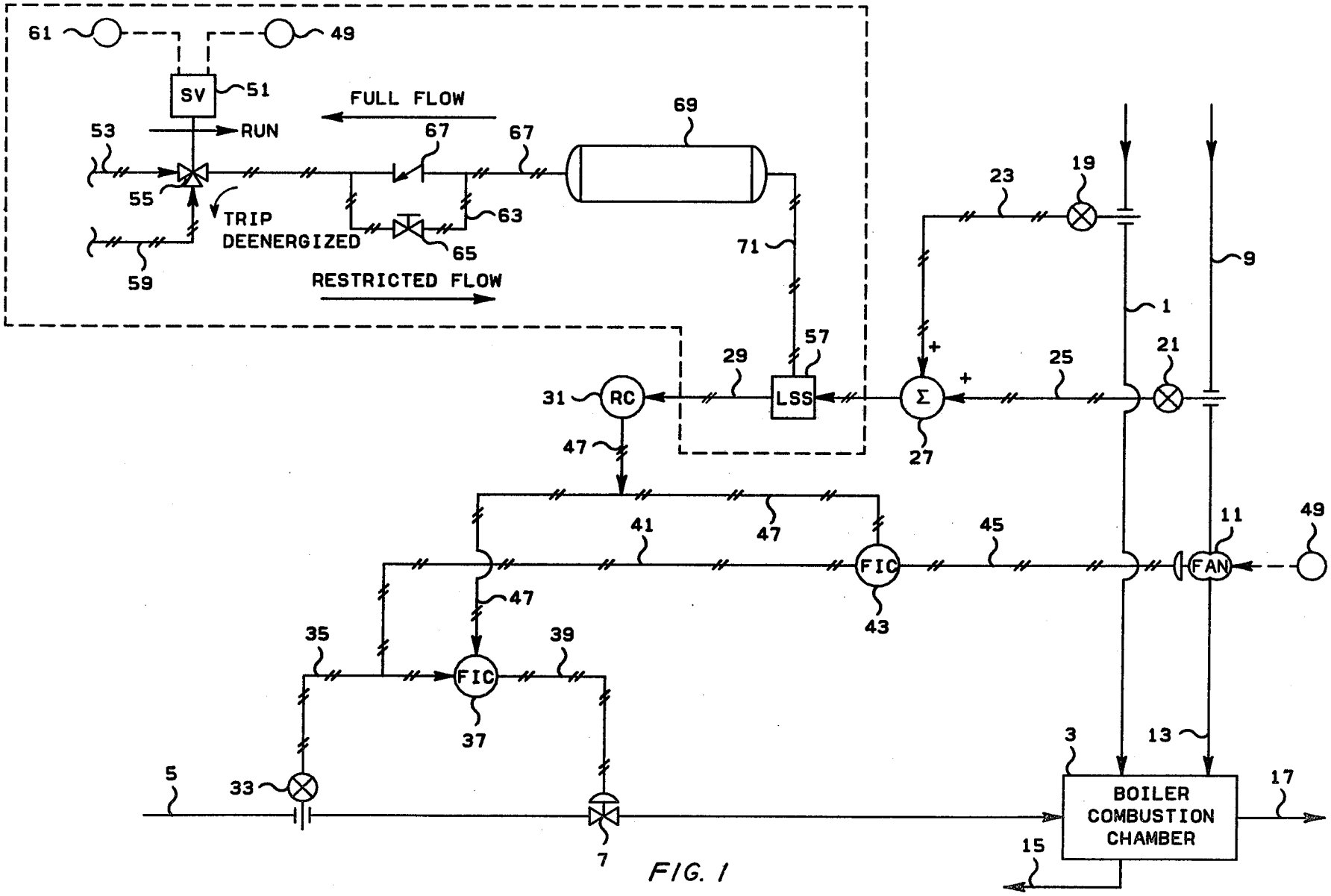
FIG. 1 is a flow diagram of the control system according to this invention.

Referring now to FIG. 1, hot exhaust air from a gas turbine is normally transferred through line 1 to a boiler combustion chamber 3. Fuel, in this case fuel oil, is transferred through line 5 which contains fuel control valve 7 into the combustion chamber 3. A secondary supply of combustion air can also be provided through line 9, force draft fan 11, and line 13 into the combustion chamber 3. In the combustion chamber the fuel is mixed with the air supply and burned to produce heat for generating steam in a boiler. Flue gas from the combustion is removed from the system in line 15 and the produced steam is removed through line 17.

The basic control system upon which the improvement of this invention operates is set out in FIG. 1.

The control system is based on flow measurements from means 19 for generating a signal indicating the flow of hot exhaust air from the gas turbine through line 1 and means 21 for generating a signal indicating the flow of fresh air induced through line 9 by forced draft fan 11. These signals are transmitted through lines 23 and 25, respectively, to a means for summing the signals 27 which transmits the summation of the signals through line 29 to a ratio controller 31.

On the fuel inlet line 5 is a means 33 for generating a signal indicating the flow of fuel through the fuel inlet line 5. This signal is transmitted through line 35 to a means 37, such as a flow indicator controller, for generating a signal 37 which is transmitted through line 39 to control valve 7 which controls the flow of fuel to boiler combustion chamber 3. The signal indicating the flow of fuel through line 5 is also transmitted through line 41 to a means 43, such as a flow indicator controller, for generating a signal which is transmitted through line 45 to control the dampers on forced draft fan 11. Both of the means 37, 43 for generating control signals are controlled through the ratio set of the signal generated from the ratio controller 31 through line 47. It can be seen that the basic control of the fuel to the boiler combustion chamber is responsively ratioed to the total flow of air to the boiler combustion chamber.

The basic control system shown in this application is commonly called "parallel control" in which the same signal, line 47, sets both fuel and air flow rates. A widely used system commonly called "lead-lag" can also be used as control system. This invention would have identical results when used in a "lead-lag" system. Lead-lag is not described since the system is well understood by those skilled in the art.

Operating with the control system as described above with the combustion air being supplied entirely by turbine exhaust gas through line 1 and with forced draft fan 11 controlled by the gas turbine tripout 49 so that the fan 11 immediately becomes operative on the failure of the gas turbine, there is sufficient lag in the control system to allow a serious condition of fuel overfeed as the supply of air from the turbine exhaust rapidly decays before the air supply from the forced draft fan becomes sufficient to supply combustion air.

Figure 2:
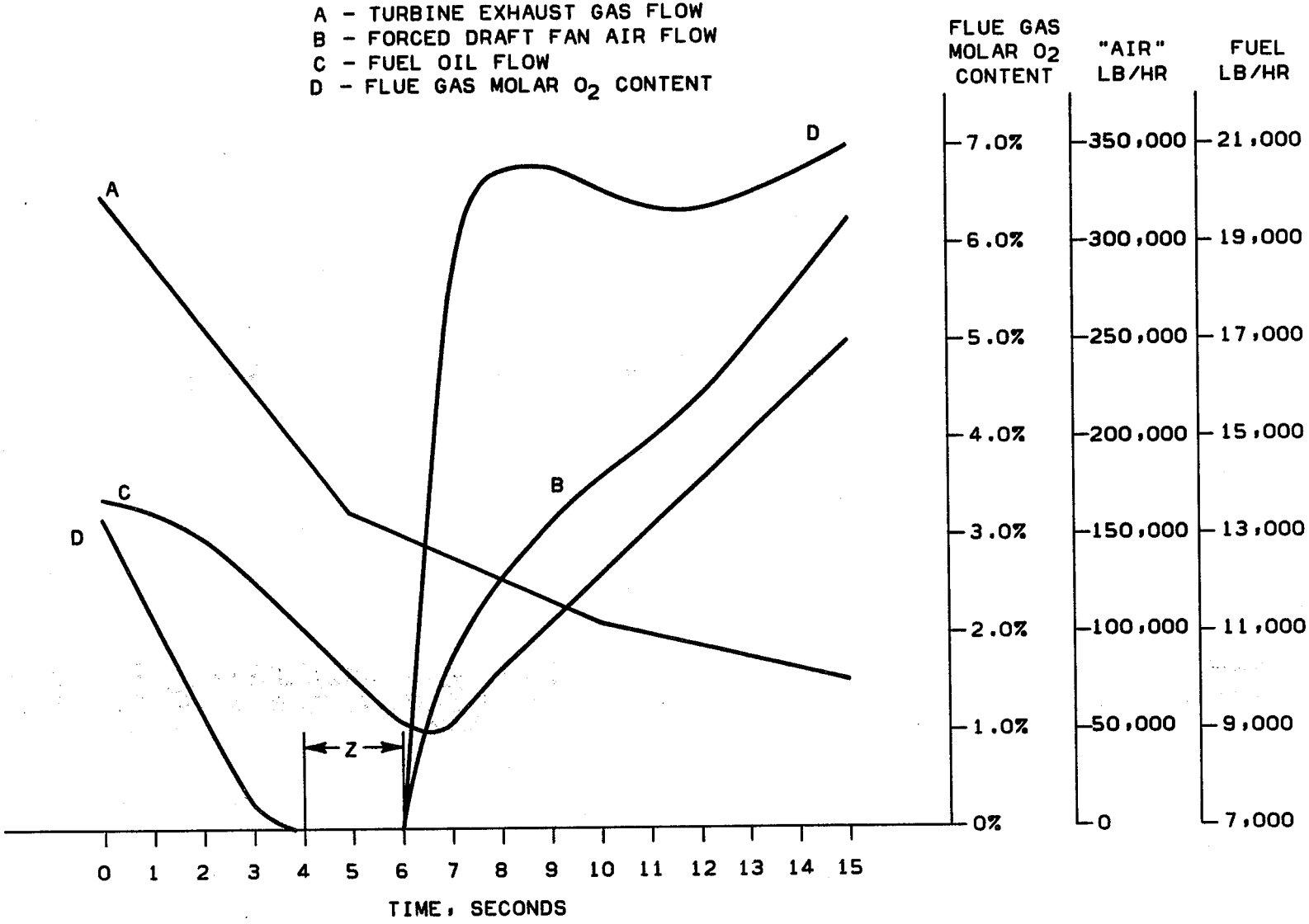
FIG. 2 is a graph of the various functions on the emergency shutdown of a turbine supplying exhaust gas as combustion air for a steam generation unit with substitution of a forced draft air flow as the source of combustion air.

This condition is graphically illustrated in FIG. 2. At zero seconds the turbine trips out. All of the functions dependent upon the air flow from the turbine immediately begin to decay. A signal is sent to the forced draft fan to begin operation, but there is an approximate six second lag before air is supplied through this means (line B). In the meantime the supply of air from the turbine exhaust gas flow (line A) decays rapidly. The ratio control cuts back on the flow of fuel oil (line C), but there is sufficient lag in this control that there is a serious overfeed of fuel for a few seconds as indicated by the molar oxygen content of the flue gas (line D) which becomes zero for the period noted as Z on the graph. To eliminate the period of excessive fuel flow, means and method are herein set forth by which the flow of fuel (line C) can be more rapidly decreased so that the flue gas molar oxygen content (line D) will not reach zero.

Referring now to the inset in FIG. 1, which describes a pnematic system, but, which can be accomplished equally well with readily available electronic systems, the same signal that the gas turbine has tripped that starts the motor of forced draft fan 11 also deenergizes solenoid valve 51 which shuts off the air supply through line 53 and threeway valve 55 to low signal selector 57 which is inserted in line 29 between the means 27 for summing the signals to indicate total air flow to the boiler combustion chamber and ratio controller 31. The pressure from the air supply in line 53 is always set higher than the maximum signal generated in response to the total air flow to the boiler combustion chamber. The operation of three-way valve 55 substitutes a low flow signal 59 at a sufficiently low pressure rapidly to drain the system's air to a pressure below the signal indicating the summation of air flow to the boiler combustion chamber. The fuel flow through the control valve 7 is rapidly cut back in ratio to this false low flow signal.

The remainder of the system illustrated in FIG. 1 discloses means by which control can be automatically reassumed in response to the signal indicating the flow of combustion air into the boiler combustion chamber. In operation, after the switch in three-way valve 55 and the draining of air pressure from the control system to match the low pressure signal through line 59, an adjustable timer 61 which has been preset to a desired lag time, for this system about six seconds, and which has been activated by the gas turbine trip, reenergizes solenoid valve 51 to switch the three-way valve 55 so that the air supply is again admitted into the system through line 53. This air supply flows through line 63 and restriction valve 65, line 67 and into volume chamber 69 which is connected to the low signal selector 57 by line 71. The restricted flow of higher pressure air into a system with built-in volume capacity chamber 69, allows the slow building of pressure against the low signal selector 57, thus allowing time for the volume of combustion air transported by forced draft fan 11 to increase sufficiently that the signal generated by summation means 27 is sufficiently high to facilitate change of control of the fuel inlet valve as the pressure through line 71 on the low selector switch 57 exceeds that of the signal generated by summation means 27 so that control is passed again to the signal generated by summation means 27.

I claim:

1. In a system for combustion of fuel to produce heat in which there are alternate primary and secondary means to supply combustion air and in which the fuel flow controlled by a fuel flow valve, is ratioed to the total air flow, a method for controlling the fuel flow to the combustion chamber on shutdown of operating of the primary means of supplying combustion air, said method comprising:

(a) activating the secondary means for supply of air, and (b) relaying a first signal to a ratio controller controlling the fuel flow valve said signal falsely indicating sufficiently low flow of air to the combustion chamber immediately to reduce flow of fuel to the combustion chamber to a flow within safe limits.

2. A method of claim 1 further comprising:

(c) continuing said first signal for a time sufficient for flow from secondary means of supply of combustion air to reach a predetermined level, (d) increasing said first signal automatically until it is greater than a second signal indicating total flow of air, and (e) shifting control of the fuel control valve to said second signal as the first signal becomes greater than the second signal.

3. In a system for combustion of fuel to produce heat, in which there are alternate primary and secondary means of supply of combustion air and in which the fuel flow is ratioed to the total air flow, apparatus for controlling the fuel flow to the combustion chamber on shutdown of operation of the primary means of the combustion air supply, said apparatus comprising:

(a) a fuel control valve, (b) a ratio controller generating a signal to operate said control valve, (c) a low signal selector relay selecting input signal to said ratio controller, (d) a device generating a signal to the low signal selector indicating the total combustion air flow, and (e) a device, actuated by shutdown of operating of primary means of combustion air supply, generating a false signal sufficiently low to reduce fuel flow within safe limits.

4. In an apparatus of claim 3 a device for generating a false signal comprising:

(a) a solenoid valve controlling air supply at a pressure in excess of the maximum signal indicating the total combustion air flow, and (b) means for deenergizing the solenoid and introducing an air supply sufficiently low rapidly to drain air pressure supplied to a low signal selector relay thereby indicating a false low air flow signal.

5. An apparatus of claim 4 further comprising:

(c) a timing device controlling reenergizing of the solenoid valve, (d) air signal supply line connecting the solenoid with the low signal selector relay, (e) a volume chamber located in the connecting line, and (f) a means in the connecting line for restricting flow from the solenoid valve to the volume chamber.

* * * * *